US006168499B1

(12) United States Patent
Jang

(10) Patent No.: US 6,168,499 B1
(45) Date of Patent: Jan. 2, 2001

(54) GRINDING APPARATUS FOR SEMICONDUCTOR WAFERS

(75) Inventor: Kwon-yuong Jang, Kyungki-do (KR)

(73) Assignee: Samsung Electronics Co., Ltd., Suwon (KR)

( * ) Notice: Under 35 U.S.C. 154(b), the term of this patent shall be extended for 0 days.

(21) Appl. No.: 09/313,651

(22) Filed: May 18, 1999

(30) Foreign Application Priority Data

May 26, 1998 (KR) ..... 98-19113

(51) Int. Cl.[7] ..... B24B 49/02; B24B 7/22

(52) U.S. Cl. ..... 451/8; 451/403; 451/388; 451/451; 134/902; 134/104.1

(58) Field of Search ..... 451/9, 8, 288, 451/287, 41, 388, 403, 289, 290, 291, 292; 33/703, 834, 833, 832, 549, 501.05, 501.02; 134/104.1

(56) References Cited

U.S. PATENT DOCUMENTS 4,109,846 * 8/1978 Pennings et al. ..... 33/174 PC
4,679,326 * 7/1987 Takizawa et al. ..... 33/170
5,718,619 * 2/1998 Merrill et al. ..... 451/41

FOREIGN PATENT DOCUMENTS

0001902 * 1/1982 (JP) ..... 33/834

* cited by examiner

*Primary Examiner*—Robert A. Rose
(74) *Attorney, Agent, or Firm*—Jones Volentine, LLC

(57) ABSTRACT

The present invention provides a grinding apparatus for semiconductor wafers for preventing the silicon powder generated from the wafer grinding process and mixed with cooling water from contaminating height gauges of the grinding apparatus because the silicon powder is scattered toward them, and for preventing wear-down of the contact heads of the height gauges due to the abrasion with a wafer to be fixed on a spin-chuck and the spin-chuck. The grinding apparatus for semiconductor wafers includes a spin-chuck for fixing a wafer to be ground and rotating the wafer; a grinder for grinding the wafer fixed on the spin-chuck by rotating and contacting the wafer over the upper side of the spin-chuck; a first cooling water supply for supplying cooling water between the surface of the wafer to be ground and the grinder; a first height gauge for measuring the vertical distance from a certain standard point to the upper surface of the wafer by using an electric signal generated according to the movement ranges of a contact head which is placed to contact of the wafer fixed on the spin-chuck; and a cover for covering the top and side of the first height gauge so as to protect the first height gauge.

20 Claims, 4 Drawing Sheets

GRINDING APPARATUS FOR SEMICONDUCTOR WAFERS

BACKGROUND OF THE INVENTION

1. Field of the Invention

The present invention relates to a grinding apparatus for semiconductor wafers, and more particularly, to a grinding apparatus for grinding semiconductor wafers while measuring the thickness of the wafers using a height gauge.

2. Description of the Related Art

In semiconductor device fabrication, a plurality of chips are formed on the wafer by carrying out various processing steps using a deposition facility, a diffusion facility, and an etching facility, etc. The wafer having a plurality of chips formed thereon is moved to an Electrical Die Sorting (EDS) facility for the EDS process, wherein the chips on the wafer go through a test to determine whether the chips are normal or abnormal, and abnormal chips are repaired.

In addition, the wafers after completing the EDS process, are moved to a back-grinding apparatus and a back-grinding process is carried out so as to grind the back side of the wafer to a certain thickness.

FIG. 1 is a plan view schematically showing a conventional back-grinding apparatus to grind the back side of the wafer, FIG. 2 is a schematic representation showing the configurations of a first height gauge, a second height gauge, a grinder, and a cooling water supply installed on the rough-grinding region and the fine-grinding region on the table depicted in FIG. 1, and FIG. 3 shows the height gauge shown in FIG. 1.

The conventional grinding apparatus for semiconductor wafers includes a round table 10, which is able to rotate 90° in any one direction. The table 10 is divided into a pie-shaped loading region 12, a rough-grinding region 14, a fine-grinding region 16, and a unloading region 18. On each region 12, 14, 16, 18 on the table 10, there is a spin-chuck 20 to suction-fix a wafer 2 and be rotated at a certain speed. On the upper surface of the spin-chuck 20, there are formed a plurality of vacuum holes (not shown), and through the plurality of vacuum holes, the air around the spin-chuck 20 is pumped inside the spin-chuck 20 so that the wafer 2 is suction-fixed on the spin-chuck 20.

In addition, as shown in FIG. 2, on the upper side of the spin-chuck 20 provided on the rough-grinding region 14 and the fine-grinding region 16 on the table 10, there is provided a grinder 30, which contacts the wafer 2 being suction-fixed on the spin-chuck 20, rotates, and grinds the wafer 2. On the lower side of the grinder 30, there is provided a diamond disk 32. In addition, on one side of the grinder 30, there is provided a cooling water supply 34 to supply cooling water between the wafer 2 and the diamond disk 32 of the grinder 30.

Around the rough-grinding region 14 and the fine-grinding region 16 of the table 10, there are provided a first height-gauge 4 and a second height-gauge 6. The first height-gauge 4 measures a vertical distance (now referred to as a first vertical distance) from a standard point (not shown) under the spin-chuck 20 to the upper surface of the wafer 2 by locating a contact head 46 on the wafer 2 fixed on the spin-chuck 20, and the second height gauge 6 measures a vertical distance (now referred to as a second vertical distance) from the standard point to the upper surface of the spin-chuck 20 by locating the contact head 46 on the spin-chuck 20. As shown in FIG. 3, there is provided a cube-shaped bed 40 on the first height-gauge 4 and the second height-gauge 6.

A certain amount of oil (not shown) is contained inside the bed 40 in order to maintain the inner temperature of the bed 40 at a specific degree, and prevent the corrosion of the inside of the bed 40. There is provided a piston 42 on the lower side of the bed 40, and there is provided a finger 44 on the end of the piston with the contact head 46 fixed thereon so as to move up and down. In addition, on the connection point of the piston 42 and the finger 44, there is provided a first connection body 48, which is able to move up and down according to the up/down movement of the finger 44. The first connection body 48 and a differential transformer 54 inside the bed 40 are connected by a second connection body 50, and so, up/down movement of the first connection body 48 is transmitted to the differential transformer 54 through the second connection body 50. The first connection body 48 is connected with the second connection body 50 through a through hole (not shown) formed in a rubber piece 52 provided on the side wall of the bed 40. The differential transformer 54 outputs an electrical signal according to the movement of the second connection body 50 connected with the first connection body 48 to the outside so as to measure the vertical distance from the standard point to the end of the contact head 46. As described above, the height gauges 4, 6 are well-known to those skilled in the art, and commercially widespread.

The wafer 2 is mounted on spin-chuck 20 installed on the loading region 12 of the table 10 by a transfer means with its upper side turned down, the air around the spin-chuck 20 is pumped to the inside of the spin-chuck 20 through the vacuum holes formed on the upper surface of the spin-chuck 20, and the wafer 2 is suction-fixed on the spin-chuck 20.

Then, with the table 10 rotating 90° in one direction, the wafer 2 on the loading region 12 of the table 10 is moved to the rough-grinding region 14 of the table 10. Then, the contact head 46 of the first height gauge 4 is placed on the wafer 2 of the rough-grinding region 14, and the contact head 46 of the second height gauge 6 is placed on the spin-chuck 20 of the rough-grinding region 14.

Therefore, each finger 44 of the first height gauge 4 and the second height gauge 6 is moved up and down, and with the up/down movement of the finger 44, the first connection body 48 and the second connection body 50 are moved. With the movement of the second connection body 50, each differential transformer 54 inside the bed 40 of the first height gauge 4 and the second height gauge 6 outputs an electrical signal according to the movement of the second connection body 50 to the outside.

Accordingly, the first vertical distance and the second vertical distance are measured, and the wafer thickness is measured by obtaining the difference between the first vertical distance and the second vertical distance.

Then, the grinder 30 is moved down such that the wafer 2 fixed on the spin-chuck 20 of the rough-grinding region 14 of the table 10, and the diamond disk 32 of the grinder 30, are brought into contact.

Then, the back side of the wafer 2 is ground according to the rotation of the grinder 30 and the spin-chuck 20, and while the grinding process goes on, the cooling water supply 34 supplies cooling water between the wafer 2 and the diamond disk 32 of the grinder 30 thereby preventing overheating due to the abrasion between the wafer 2 and the diamond disk 32, and cleaning the silicon powder generated grinding the wafer.

During the grinding process, the first height gauge 4 and the second gauge 6 continuously measure the thickness of the wafer 2, and if the wafer is ground down to a desired thickness set by the thickness measurement, the spin-chuck 20 and the grinder 30 stop their rotation.

Then, while the table 10 rotates 90° in one direction, the wafer 2 on the rough-grinding region 14 of the table 10 is moved to the fine-grinding region 16, and the grinding process is carried out in the fine-grinding region 16 in the same manner as in the rough-grinding region 14, i.e., the thickness of the wafer 2 is measured using the first height gauge 4 and the second height gauge 6 around the fine-grinding region 16, and the back side of the wafer 2 is precisely fine-ground to a certain thickness using another grinder on the upper side of the fine-grinding region 16.

While the wafer 2 is fine-ground in the fine-grinding region 16 of the table 10, the cooling water supply 34 on one side of the grinder supplies cooling water between the wafer 2 and the diamond disk of the grinder thereby preventing the overheating due to the abrasion of the wafer 2 and the diamond disk 32, and cleaning the silicon powder generated during the grinding of the wafer.

Finally, with the table 10 rotating 90° in one direction, the wafer 2 of the fine-grinding region 16 of the table 10 is moved to an unloading region 18 of the table 10, and the wafer 2 in the unloading region 18 is put in a cassette by a transfer means. In addition, as described above, while the table 10 rotates at every rotation by 90°, a new wafer 2 to be ground is loaded in the loading region 12, and the grinding process continuously goes on.

The silicon powder as material of the wafer 2, which is generated during grinding the back side of the wafer 2 using the grinder 30, is mixed with cooling water supplied from the cooling water supply 34, and is scattered to the height gauges 4,6 by centrifugal force due to the rotation of the grinder 30 and the spin-chuck 20. If the silicon powder mixed with the cooling water is scattered to the rubber 52 of the height gauges 4,6, the silicon powder is hardened with the passage of time, and it is introduced into the bed 40 through the through hole of the rubber 52 thereby contaminating the oil inside the bed 40. As a result, the inner temperature of the bed 40 is changed due to the contamination of the oil, and the height gauges 4,6 often malfunctions. Also, corrosion occurs inside the bed 40. In addition, if the silicon powder is scattered to the contact head 46 of the height gauges 4,6, the silicon powder mixed with the cooling water is hardened with the passage of time, to form a lump of the silicon powder having a certain thickness on the end of the contact head 46. Due to the lump of the silicon powder, the reliability of the resulting value of the thickness of the wafer 2 using the height gauges 4,6 is deteriorated.

In addition, even if cooling water is supplied between the wafer 2 and the diamond disk 32 of the grinder 30, the cooling water is not supplied between the wafer 2 or the spin-chuck 20 and the contact head 46 of the height gauges 4,6 thereby generating heat due to the abrasion of the contact head 46 of the height gauges 4,6 and easily causing wear-down.

SUMMARY OF THE INVENTION

The present invention is directed to provide a grinding apparatus for semiconductor wafers for preventing the silicon powder generated from the wafer grinding process and mixed with cooling water from contaminating height gauges of the grinding apparatus because the silicon powder is scattered toward them.

Another object of the present invention is to provide a grinding apparatus for semiconductor wafers for preventing wear-down of the contact measures of the height gauges due to the abrasion with a wafer to be fixed on a spin-chuck, and with the spin-chuck.

To achieve these and other advantages and in accordance with the present invention, the grinding apparatus for semiconductor wafers comprises a spin-chuck for fixing a wafer to be ground and rotating the wafer; a grinder for grinding the wafer fixed on the spin-chuck by contacting with the wafer over the upper side of the spin-chuck, and rotating; a first cooling water supply for supplying cooling water between the surface of the wafer to be ground and the grinder; a first height gauge for measuring the vertical distance from a certain standard point to the upper surface of the wafer by using an electric signal generated according to the movement ranges of a contact head which is placed to contact the upper surface of the wafer fixed on the spin-chuck; and a first cover for covering the top and sides of the first height gauge so as to protect the first height gauge.

The grinding apparatus for semiconductor wafers further comprises a second cooling water supply for supplying cooling water between the contact head of the first height gauge and the surface of the wafer. The second cooling water supply has a cooling water supply line and a nozzle connected with the end of the cooling water supply line, and the second cooling water supply is provided inside the first cover.

The grinding apparatus for semiconductor wafers further comprises a second height gauge for measuring the vertical distance from a certain standard point to the upper surface of the spin-chuck by using an electric signal generated according to the movement ranges of the contact head which is placed to contact the upper surface of the spin-chuck; and a second cover for covering the top and sides of the second height gauge so as to protect the second height gauge. The grinding apparatus for semiconductor wafers may further comprise a third cooling water supply having a cooling water supply line and a nozzle connected with the end of the cooling water supply line for supplying cooling water between the contact head of the second height gauge and the upper surface of the spin-chuck. The third cooling water supply may be provided inside the second cover.

In addition, the first and the second covers covering the first height gauge and the second height gauge are preferably made of transparent plastic material, such as an acrylic acid resin, etc.

The first and the second covers covering the first height gauge and the second height gauge are detachably installed in the first height gauge, and the second height gauge respectively.

According to another aspect of the present invention, a grinding apparatus for semiconductor wafers comprises a table which is round and rotatable over a certain angle, and divided into a loading region for loading a wafer to be ground, an unloading region for unloading a ground wafer, and a plurality of process regions for carrying out the grinding process; a plurality of spin-chucks, each of which provided in the loading region, the unloading region, and the process regions, for fixing and rotating the wafer; a plurality of rotating grinders for grinding the wafers by contacting the wafers fixed on the spin-chucks installed in the process regions of the table; and a first cooling water supply for supplying cooling water between the wafer and the grinders; a first height gauge for measuring the vertical distance from a certain standard point to the upper surface of the wafer by using an electric signal generated according to the movement ranges of the contact head which is placed to contact the upper surface of the wafer fixed on the spin-chuck on the process region of the table; a second height gauge for measuring the vertical distance from a certain standard point to the upper surface of the spin-chuck by using an electric signal generated according to the movement ranges of the contact head which is placed to contact the upper surface of the spin-chuck provided on the process region of the table; a first cover covering the top and sides of the first height gauge for protecting the first height gauge; and a second cover covering the top and sides of the second height gauge for protecting the second height gauge.

It is to be understood that both the foregoing general description and the following detailed description are exemplary and explanatory and are intended to provide further explanation of the invention as claimed.

DETAILED DESCRIPTION OF THE PREFERRED EMBODIMENTS

Hereinafter, detailed descriptions of preferred embodiments of the present invention will be described with reference to the accompanying drawings; however the scope of the invention is not limited to the embodiments set forth herein.

Figure 1:
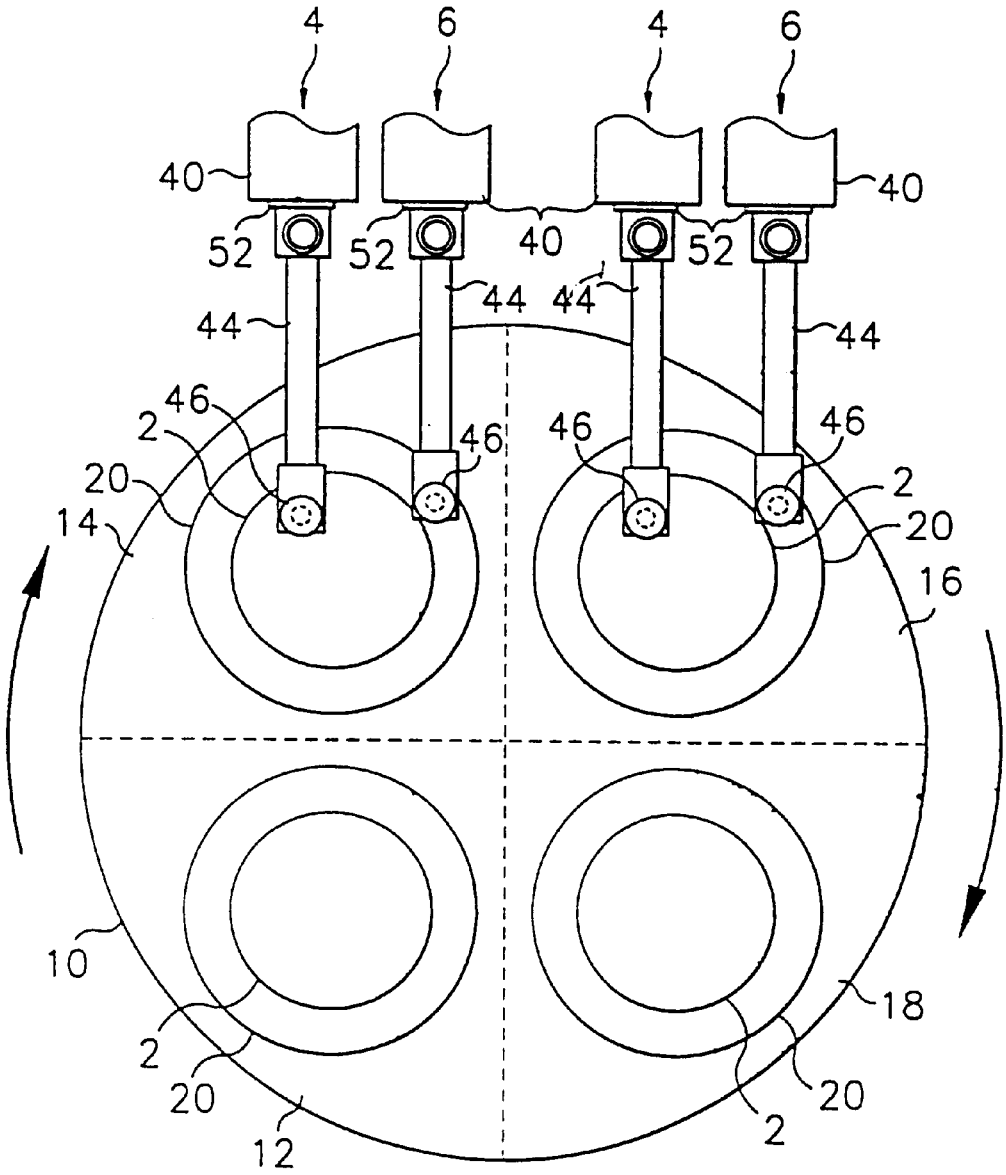
FIG. 1 (Prior Art)
FIG. 1 is a plan view schematically showing a conventional grinding apparatus to grind the back side of the wafer.
Figure 4:
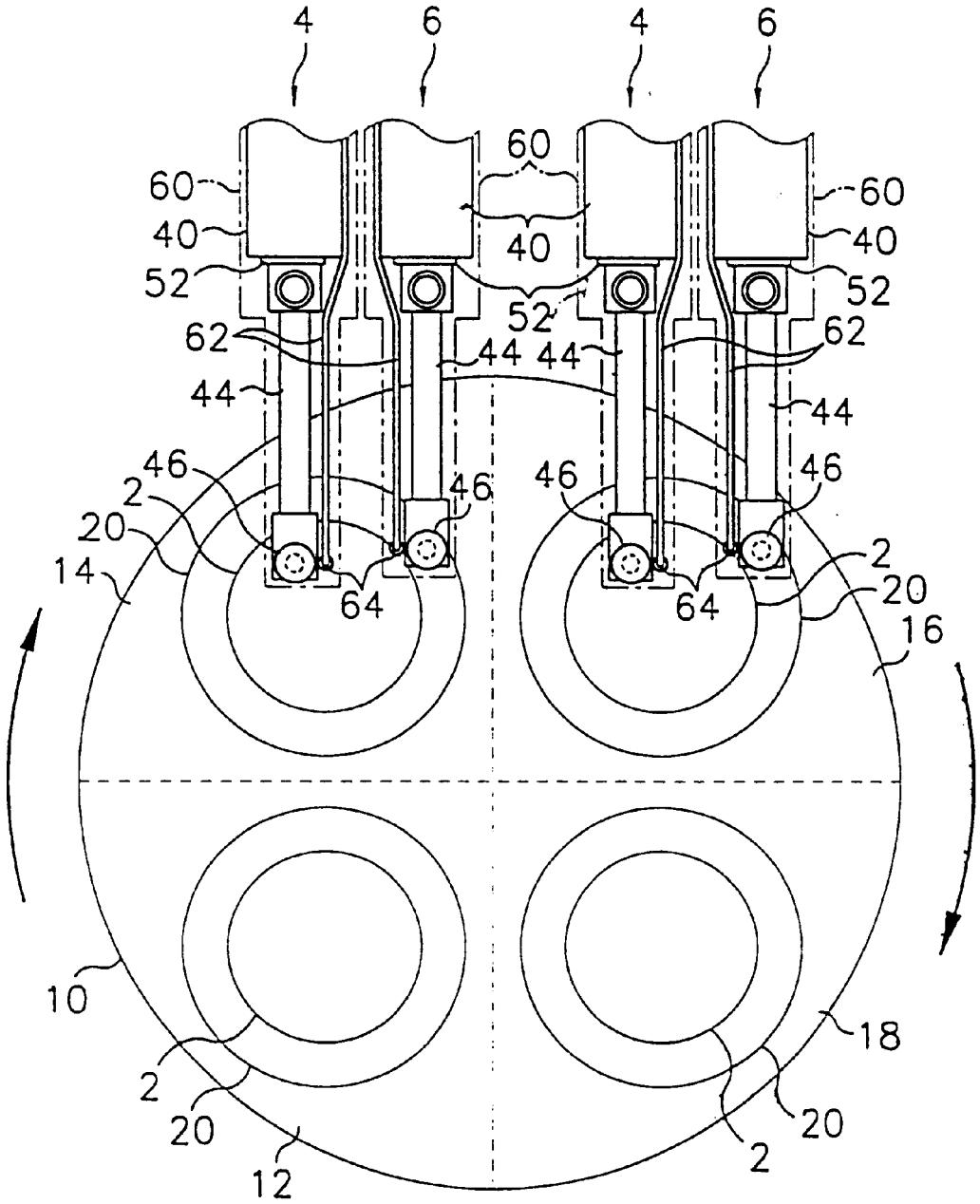
FIG. 4 is a plan view schematically showing a grinding apparatus to grind the back side of the wafer according to the present invention.
Figure 5:
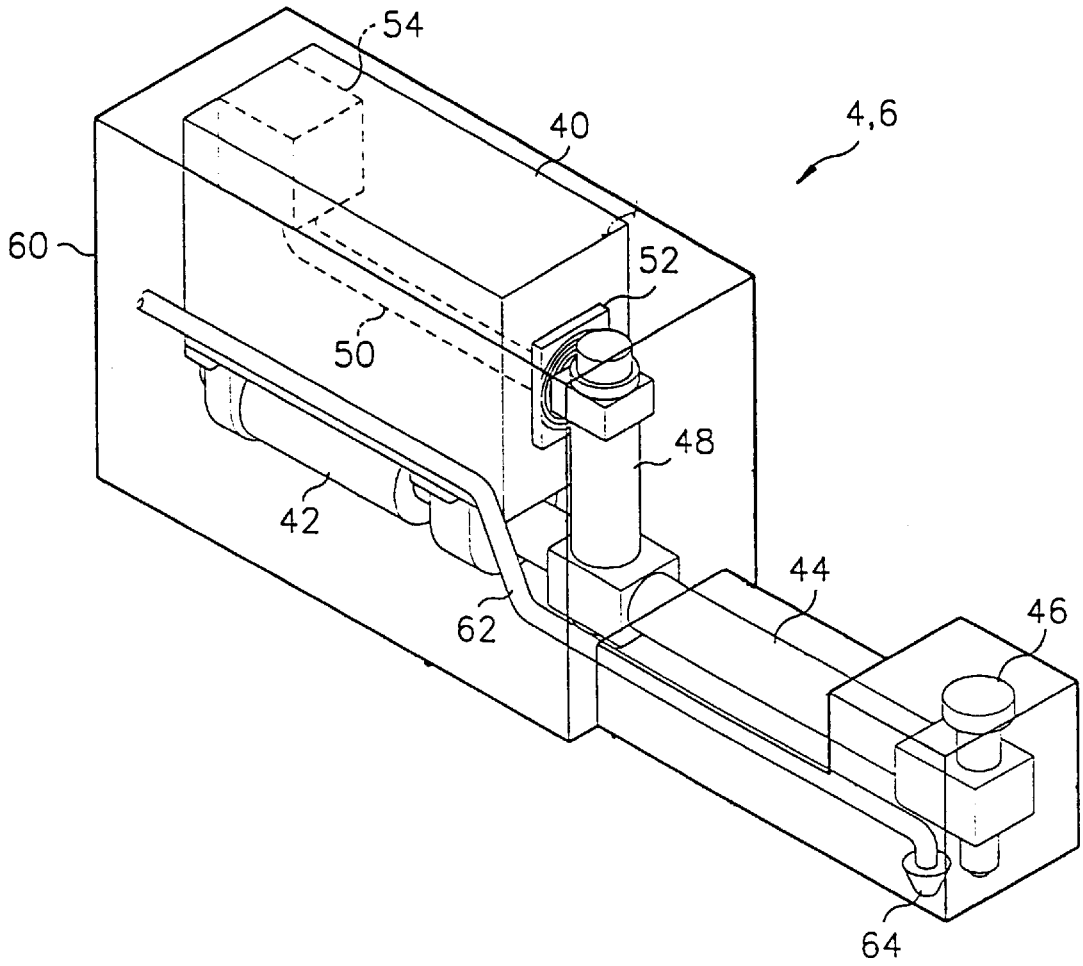
FIG. 5 is a schematic representation showing the configurations of the grinding apparatus of the semiconductor wafers depicted in FIG. 4 according to one embodiment of the present invention.

FIG. 4 is a plan view schematically showing a grinding apparatus to grind the back side of the wafer according to the present invention, and FIG. 5 is a schematic representation showing the configurations of the grinding apparatus of the semiconductor wafers depicted in FIG. 4 according to one embodiment of the present invention. Like numbers refer to like elements shown in the FIGS. 1 and 2.

As shown in FIG. 4, the grinding apparatus for semiconductor wafers according to the present invention comprises a round-shaped indexing table 10 which is able at a time in rotate 90° to one direction. The table 10 is divided into a loading region 12 for loading a wafer 2 to be ground, a rough-grinding region 14 for rough-grinding the loaded wafer 2, a fine-grinding region 16 for precisely grinding the rough-ground wafer to a certain thickness, and an unloading region 18 for unloading the ground wafer 2 to a certain location. On each region 12,14,16,18 on the table 10, there is a rotary chuck referred to as a spin-chuck 20 to suction-fix a wafer 2 and be rotated at a certain speed. On the upper surface of the spin-chuck 20, there are formed a plurality of vacuum holes (not shown), and through the plurality of vacuum holes, the air around the spin-chuck 20 is pumped inside the spin-chuck 20 so that the wafer 2 is suction-fixed on the spin-chuck 20.

Figure 2:
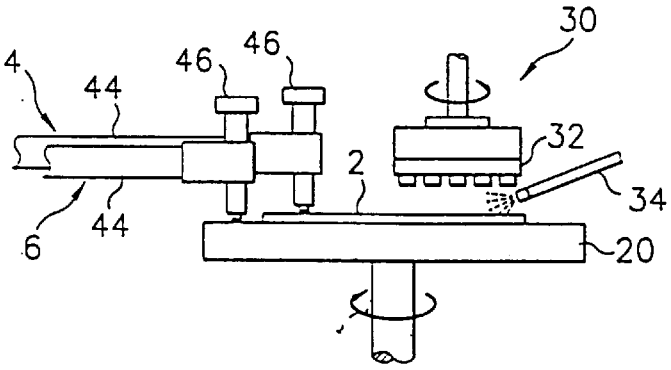
FIG.2 (Prior Art)
FIG. 2 is a schematic representation showing the configurations of a first height gauge, a second height gauge, a grinder, and a cooling water supply installed on the rough-grinding region and the fine-grinding region on the table depicted in FIG. 1.
Figure 3:
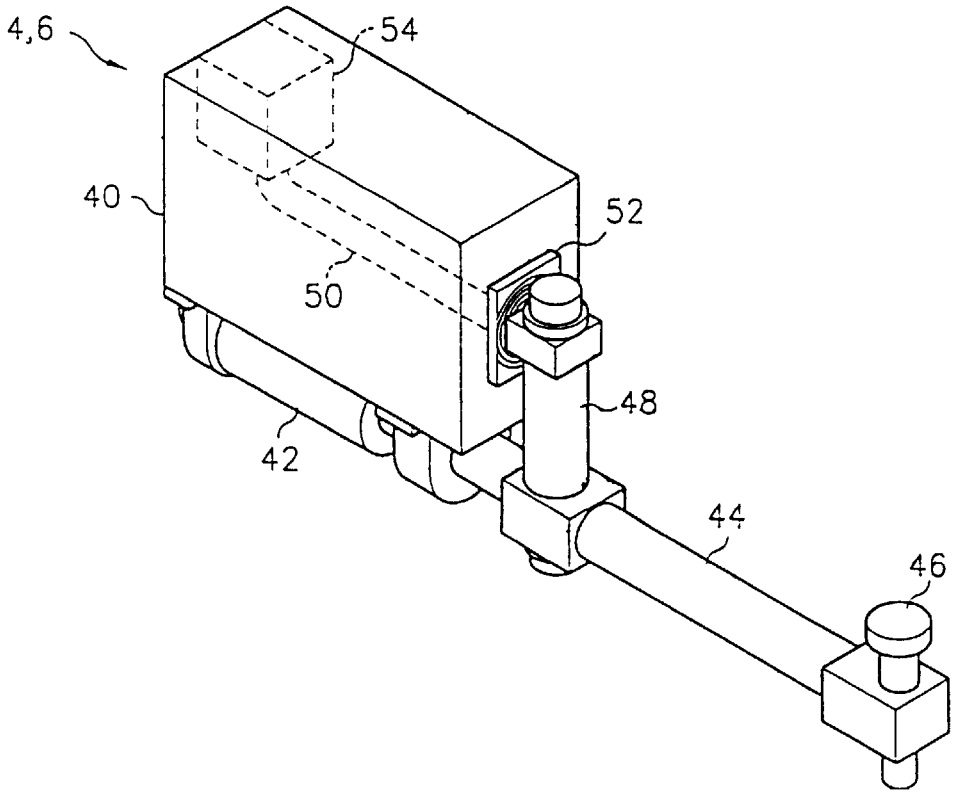
FIG.3 (Prior Art)
FIG. 3 shows the height gauge shown in FIG. 1.

In addition, as shown in FIG. 2, there is provided a grinder 30 on the upper side of the spin-chuck 20 provided on the rough-grinding region 14 and the fine-grinding region 16 on the table 10, and the grinder 30 contacts with the wafer 2 being suction-fixed on the spin-chuck 20, rotates, and grinds the wafer 2. On the lower side of the grinder 30, there is provided a diamond disk 32 having diamonds of a certain size spaced a certain distance apart from each other attached thereon. In addition, on one side of the grinder 30, there is provided a cooling water supply 34 to supply cooling water such as deionized water between the wafer 2 and the diamond disk 32 of the grinder 30.

There is provided a first height gauge 4 on the rough-grinding region 14 and the fine-grinding region 16 of the table 10, the first height gauge 4 measuring a vertical distance (now referred to as a first vertical distance) from a standard point (not shown) on the lower side of the spin-chuck 20 to the upper surface of the wafer 2.

There is provided a second height gauge 6 on the rough-grinding region 14 and the fine-grinding region 16 of the table 10, the second height gauge 6 measuring a vertical distance (now referred to as a second vertical distance) from a standard point (not shown) to the upper side surface of the spin-chuck 20. According one manufacturing variation, only the first height gauge 4 is installed on the rough-grinding region 14 and the fine-grinding region 16, respectively, and the thickness of the wafer 2 can be achieved by subtracting a second vertical distance measured by many methods from the first vertical distance measured by the first height gauge 4 so as to carry out the grinding process. As shown in FIG. 5, the height gauges 4,6 each include a rectangular oil housing or bed 40.

That is, a certain amount of oil (not shown) is contained inside the bed 40 in order to maintain the interior of the bed 40 at a specific temperature, and to prevent the corrosion of the inside of the bed 40. There is provided a piston 42 on the lower side of the bed 40, and there is provided a finger 44 having the contact head 46 fixed thereon on the end of the piston 42 so as to move up and down. In addition, on the connection point of the piston 42 and the finger 44, there is provided a first connection body 48, which is able to move up and down according to the up/down movement of the finger 44. The first connection body 48 and a differential transformer 54 are connected by a second connection body 50, and so, up/down movement of the first connection body 48 is transmitted to the differential transformer 54 through the second connection body 50. The first connection body 48 is connected with the second connection body 50 through a through hole (not shown) formed on a rubber piece 52 provided on the side wall of the bed 40. The differential transformer 54 outputs an electrical signal according to the movement of the second connection body 50 connected with the first connection body 48 to the outside so as to measure the first vertical length or the second vertical length. As described above, the height gauges 4,6 are well-known to those skilled in the art, and commercially widespread.

There is provided a cover 60 for covering the top and sides of the first height gauge 4 and the second height gauge 6, respectively, for preventing the first height gauge 4 and the second height gauge 6 from being contaminated. The cover 60 is detachably installed from the first height gauge 4 and the second height gauge 6, and the cover 60 is made of transparent plastic material such as acrylic acid resin, etc.

In addition, there is provided a cooling water supply line 62 inside the cover 60 of the first height gauge 4 with a nozzle 64 on its end for supplying cooling water such as deionized water between the wafer 2 and the contact head 46, and there is also provided a cooling water supply line 62 inside the cover 60 of the second height gauge 6 with a nozzle 64 on its end for supplying cooling water between the spin-chuck 20 and the contact head 46. According to one manufacturing variation, the cooling water supply line 62 having a nozzle 64 on its end may be installed outside the cover 60 of the first height gauge 4 and the second height gauge 6.

Accordingly, if the wafer 2 is mounted with its front side turned down on the spin-chuck 20 of the loading region 12 of the table 10 by transfer means, the air around the spin-chuck 20 is pumped inside the spin-chuck 20 through the vacuum hole, and the wafer 2 is suction-fixed on the spin-chuck 20.

Then, with the table 10 rotated 90° in one direction, the wafer 2 on the loading region 12 of the table 10 is moved to the rough-grinding region 14 of the table 10. Then, the contact head 46 of the first height gauge 4 is placed on the wafer 2 on the rough-grinding region 14, and the contact head 46 of the second height gauge 6 is placed on the spin-chuck 20 on the rough-grinding region 14. Then, each finger 44 of the height gauges 4,6 move up and down, and with the movement of the finger 44, the first connection body 48 and the second connection body 50 move. With the movement of the second connection body 50, the differential transformer 54 inside the bed 40 outputs an electrical signal according to the movement of the second connection body 50 outside.

Accordingly, the first vertical distance and the second vertical distance are measured, and by subtracting the second vertical distance from the first vertical distance, the thickness of the wafer can be obtained.

Then, the grinder 30 on the upper side of the rough-grinding region 14 of the table 10 is moved down, and contacts the wafer 2 fixed on the spin-chuck 20. Then, with the grinder 30 and the spin-chuck 20 rotated at high speed, the back side of the wafer 2 is ground. While the grinding process goes on, the first height gauge 4 and the second height gauge 6 continuously measure the thickness of the wafer 2. When the wafer 2 is ground to a desired thickness, the spin-chuck 20 and the grinder 30 stop their rotation. While the grinding process is performed on the rough-grinding region 14, cooling water is supplied between the wafer 2 and the diamond disk 32 of the grinder 30 from the cooling water supply 34 on one side of the grinder 30 a thereby preventing the abrasion of the wafer 2 and the diamond disk 32. With the cover 60 on the first height gauge 4 and the second height gauge 6, the rubber piece 52 of the height gauges 4,6 and the contact head 46 can be protected from the silicon powder which is generated from the grinding of the wafer 2, and scattered toward the height gauges 4,6.

In addition, by manufacturing the cover 60 with transparent plastic material such as acrylic resin, etc., the operators can detect the contamination on the surface of the height gauges 4,6 easily, and the cover 60 can be easily replaced with a new one by manufacturing it detachably from the height gauges 4,6.

In addition, by supplying cooling water between the wafer 2 and the first height gauge 4, and between the spin-chuck 20 and the second height gauge 6, the wear-down due to the abrasion of the contact head 46 of the height gauges 4,6 and the wafer 2, or the spin-chuck 20, can be prevented.

Continuously, with the table 10 rotated at 90° in one direction, the wafer 2 of the rough-grinding region 14 of the table 10 is moved to a fine-grinding region 16 of the table 10, and the fine-grinding process is performed for the rough-ground wafer 2 in the same manner as in the rough-grinding process using the first height gauge 4, and the second height gauge 6, and measuring the thickness of the wafer 2, and using the grinder 30 so that the back side of the wafer 2 is precisely fine-ground until reaching a certain thickness. While the fine-grinding process is performed on the fine-grinding region 16 of the table 10, the cooling water supply 34 on one side of the grinder 30 supplies cooling water between the wafer 2 and the diamond disk 32 of the grinder 30, thereby preventing abrasion of the wafer 2 and the diamond disk 32 by their rotation, and cleaning the silicon powder generated from the grinding of the wafer 2.

In addition, with a cover 60 provided on the height gauges 4,6 around the fine-grinding region 16 like the cover 60 provided on the height gauges 4,6 around the rough-grinding region 14, the contamination of the rubber piece 52 of the height gauges 4,6 and the contact head 46, due to the silicon powder which is generated from the grinding of the wafer 2 and scattered mixed with cooling water, can be prevented.

In addition, by supplying cooling water between the wafer 2 of the fine-grinding region 16 of the table and the contact head 46 of the first height gauge 4, and between the spin-chuck 20 of the fine-grinding region 16 and the contact head 46 of the second height gauge 6, wear-down of the contact head 46 of the height gauges 4,6 and the spin-chuck 20 due to the abrasion of their rotation can be prevented.

Then, with the table 10 rotated 90° in one direction, the wafer 2 of the fine-grinding region 16 of the table 10 can be moved to the unloading region 18 of the table 10, and the wafer 2 on the unloading region 18 of the table 10 is moved to a cassette by a transfer means. While the table 10 is rotated by 90°, a new wafer 2 to be ground is loaded on the loading region 12 of the table 10, and the grinding process continuously goes on.

Therefore, according to the present invention, the contamination of the height gauges by the silicon powder mixed with cooling water is prevented, and also, the corrosion inside the bed due to the contamination of the oil inside the bed by the silicon powder introduced into the bed is prevented by providing a cover on the height gauges.

In addition, formation of the lump on the end of the contact head, due to the silicon powder attached/hardened on the contact head, is prevented thereby improving the reliability of the resulting value for the thickness of the wafer.

In addition, wear-down of the contact head is prevented by supplying cooling water around the contact head of the height gauges.

It will be apparent to those skilled in the art that various modifications and variations of the present invention can be made without departing from the spirit or scope of the invention. Thus, it is intended that the present invention cover the modifications and variations of this invention provided they come within the scope of the appended claims and their equivalents.

What is claimed is:

1. A grinding apparatus for grinding semiconductor wafers, comprising:

a rotary chuck to which a wafer to be ground is fixable;

a grinder disposed over the rotary chuck, the grinder having a grinding disc, and a rotary shaft to which said grinding disc is mounted, whereby the wafer fixed to the chuck is ground by placing the grinding disc in contact with a principal surface of the wafer and rotating the disc;

a first cooling water supply system which supplies cooling water between the principal surface of the wafer and the grinder;

a first height gauge having a first contact head, a first housing supporting said contact head, and first differential transformer means operatively connected to said first connection body for outputting an electric signal corresponding to the vertical distance between a reference point and a tip of said contact head, whereby the first height gauge measures the vertical distance from a standard reference point to the principal surface of the wafer by placing the tip of said contact head in contact with the principal surface of the wafer at a predetermined location, and generating an electric signal indicative of the position of said first contact head relative to the principal surface of the wafer; and a first cover covering said contact head and said housing of the first height gauge so as to protect said contact head from particles produced during the grinding of the wafer.

2. The grinding apparatus of claim 1, and further comprising a second cooling water supply system having a cooling water supply line, and a nozzle connected with an end of the cooling water supply line, which supplies cooling water between the contact head of said first height gauge and the principal surface of the wafer.

3. The grinding apparatus of claim 2, wherein the cooling water supply line and the nozzle of said second cooling water supply are disposed inside said first cover.

4. The grinding apparatus of claim 1, and further comprising:

a second height gauge having a second contact head, a second housing supporting said second contact head, and second differential transformer means operatively connected to said second connection body for outputting an electric signal corresponding to the vertical distance between said reference point and an upper surface of said rotary chuck, whereby the second height gauge measures the vertical distance from said standard reference point to said upper surface of the rotary chuck by placing a tip of said second contact head in contact with said upper surface of the rotary chuck at a predetermined location, and generating an electric signal indicative of the position of said second contact head relative to the upper surface of said rotary chuck; and a second cover covering said contact head and said housing of the second height gauge so as to protect said second contact head from particles produced during the grinding of the wafer.

5. The grinding apparatus of claim 4, and further comprising a second cooling water supply system having a cooling water supply line, and a nozzle connected with an end of the cooling water supply line, which supplies cooling water between the contact head of said first height gauge and the principal surface of the wafer, and a third cooling water supply system having a cooling water supply line and a nozzle connected with an end of the cooling water supply line, which supplies cooling water between the contact head of the second height gauge and the upper surface of said rotary chuck.

6. The grinding apparatus of claim 5, wherein the cooling water supply line and the nozzle of said third cooling water supply system are disposed inside said second cover.

7. The grinding apparatus of claim 4, wherein the first and the second covers are each made of transparent plastic material.

8. The grinding apparatus of claim 7, wherein the first cover and the second cover are each made of an acrylic acid resin.

9. The grinding apparatus of claim 4, wherein the first and the second covers are detachably mounted to the first height gauge and the second height gauge, respectively.

10. The grinding apparatus of claim 1, wherein the grinding apparatus is a back-grinding apparatus for grinding a back side of the wafer.

11. A grinding apparatus for grinding semiconductor wafers, comprising:

an indexing table which is rotatable over certain angular increments and defines a loading region at which a wafer to be ground is loaded onto the table, an unloading region at which a ground wafer is unloaded, and a plurality of process regions at which a grinding process is carried out on the wafer;

a plurality of rotary chucks supported by said table so as to be located at the process regions, the loading region, and the unloading region, respectively, at a given time;

a plurality of grinders located above the process regions of said indexing table, respectively, each of said grinders having a grinding disc, and a rotary shaft to which said grinding disc is mounted, whereby the wafers fixed to the chucks at said process regions are ground by placing the grinding discs in contact with a principal surface of each of the wafers and rotating the discs;

a first cooling water supply system which supplies cooling water between the wafers at said process regions and the grinders;

a first height gauge located at one of said process regions, said first height gauge having a first contact head, a first housing supporting said contact head, and differential transformer means operatively connected to said first connection body for outputting an electric signal corresponding to the vertical distance between a reference point and a tip of said contact head, whereby the first height gauge measures the vertical distance from a standard reference point to the principal surface of one of the wafers by placing the tip of said contact head in contact with the principal surface of the wafer fixed to the rotary chuck positioned by the indexing table at said one of the process regions, and generating an electric signal indicative of the position of said first contact head relative to the principal surface of the wafer;

a second height gauge located at said one of the process regions, said second height gauge having a second contact head, a second housing supporting said second contact head, and differential transformer means operatively connected to said second connection body for outputting an electric signal corresponding to the vertical distance between said reference point and an upper surface of said rotary chuck positioned by said indexing table at said one of the process regions, whereby the second height gauge measures the vertical distance from said standard reference point to an upper surface of the rotary chuck positioned at said one of the process regions by placing a tip of said second contact head in contact with said upper surface of the rotary chuck at a predetermined location, and generating an electric signal indicative of the position of said second contact head relative to the upper surface of said rotary chuck;

a first cover covering the housing and the contact head of said first height gauge so as to protect the first contact head of said first height gauge from particles produced during the grinding of the wafer at said one of the process regions; and a second cover covering the housing and the contact head of said second height gauge so as to protect the second contact head of said second height gauge from particles produced during the grinding of the wafer at said one of the process regions.

12. The grinding apparatus of claim 11, and further comprising a second cooling water supply system having a cooling water supply line and a nozzle connected with an end of said cooling water supply line, which supplies cooling water between the first contact head of said first height gauge and the surface of the wafer at said one of the process regions; and a third cooling water supply system having a cooling water supply line and a nozzle connected with an end of said cooling water supply line, which supplies cooling water between the second contact head of said second height gauge and the upper surface of said rotary chuck positioned by said indexing table at said one of the process regions.

13. The grinding apparatus of claim 12, wherein the cooling water supply line and the nozzle of said second cooling water supply system are disposed inside said first cover and the cooling water supply line and the nozzle of said third cooling water supply are disposed inside said second cover.

14. The grinding apparatus of claim 1, wherein said first height gauge also has machine oil in said first housing, a first connection body operatively connected to said first contact head so as to move up and down therewith, a second connection body extending through said housing and connecting said first connection body to said first differential transformer means, and a rubber seal mounted to said housing and providing a seal at a location where said first and second connection bodies are connected, and wherein said rubber seal is located inside said first cover, whereby said first cover prevents contaminants from accumulating on said seal.

15. The grinding apparatus of claim 1, wherein said first cover covers the top and sides of both said first housing and said first contact head.

16. The grinding apparatus of claim 11, wherein said first height gauge also has machine oil in said first housing, a first connection body operatively connected to said first contact head so as to move up and down therewith, a second connection body extending through said first housing and connecting said first connection body to said first differential transformer means, and a first rubber seal mounted to said housing and providing a seal at a location where the first and second connection bodies of said first height gauge are connected, said second height gauge also has machine oil in said second housing, a first connection body operatively connected to said second contact head so as to move up and down therewith, a second connection body extending through said housing and connecting said first connection body to said second differential transformer means, and a second rubber seal mounted to said second housing and providing a seal at a location where the first and second connection bodies of said second height gauge are connected, and wherein said first and second rubber seals are located inside said first and second covers, respectively, whereby said covers prevent contaminants from accumulating on said seals.

17. The grinding apparatus of claim 11, wherein said first cover covers the top and sides of both the first housing and the first contact head of said first height gauge, and said second cover covers the top and sides of both the second housing and the second contact head of said second height gauge.

18. The grinding apparatus of claim 11, wherein the first and the second covers are each made of transparent plastic material.

19. The grinding apparatus of claim 18, wherein the first cover and the second cover are each made of an acrylic acid resin.

20. The grinding apparatus of claim 11, wherein the first and the second covers are detachably mounted to the first height gauge and the second height gauge, respectively.

* * * * *